United States Patent [19]

Royce

[11] Patent Number: 4,466,003

[45] Date of Patent: Aug. 14, 1984

[54] COMPACT WIDEBAND MULTIPLE CONDUCTOR MONOPOLE ANTENNA

[75] Inventor: Richard K. Royce, Alexandria, Va.

[73] Assignee: The United States of America as represented by the Secretary of the Navy, Washington, D.C.

[21] Appl. No.: 347,219

[22] Filed: Feb. 9, 1982

[51] Int. Cl.[3] ..... H01Q 9/22

[52] U.S. Cl. ..... 343/826; 343/749

[58] Field of Search ..... 343/792, 893, 895, 749, 343/826, 751

[56] References Cited

U.S. PATENT DOCUMENTS

| | | | |
|---|---|---|---|
| 2,535,298 | 12/1950 | Lattin | 343/802 |
| 3,550,145 | 12/1970 | Tai | 343/893 |
| 4,302,760 | 11/1981 | Laufer | 343/893 |
| 4,359,743 | 11/1982 | De Santis | 343/885 |

*Primary Examiner*—Eli Lieberman

*Attorney, Agent, or Firm*—Robert F. Beers; William T. Ellis; Alan P. Klein

[57] ABSTRACT

A wideband trap-loaded monopole antenna having small structural dimensions in a plane normal to the polarization axis. The traps are resistively-terminated quarter wavelength transmission lines. The locations and anti-resonant frequencies of the traps are selected to make the antenna's input impedance and gain nominally uniform parameters with respect to frequency.

4 Claims, 1 Drawing Figure

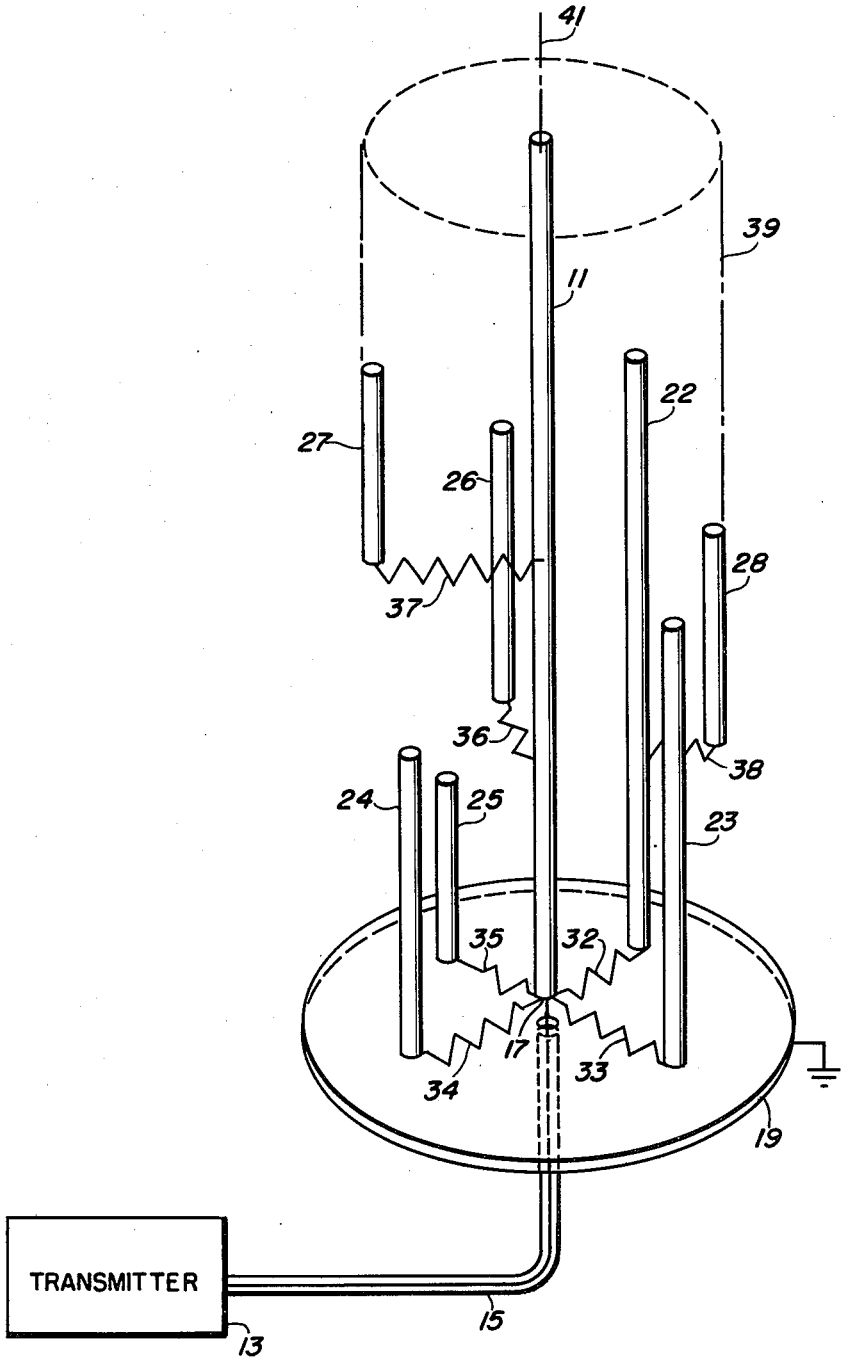
41
39
11
22
27
26
28
37
36
38
24
25
23
35
32
17
34
33
19
TRANSMITTER
15
13

COMPACT WIDEBAND MULTIPLE CONDUCTOR MONOPOLE ANTENNA

BACKGROUND OF THE INVENTION

The present invention relates generally to antennas, and more particularly to wideband transmitting antennas.

Prior art transmitting antennas used in shipboard communication systems only have acceptable impedance characteristics over bandwidths whose upper and lower limits are in the ratio of 3 to 1, requiring the use of three relatively large structures to cover the 2–30 MHz high-frequency band. Reduction in the number and size of the transmitting antennas would permit the transmitting antennas to be spaced further from nearby receiving antennas, thereby reducing coupling between the transmitting and receiving antennas.

SUMMARY OF THE INVENTION

Accordingly, it is an object of the present invention to provide a single antenna having acceptable impedance characteristics over the entire high-frequency band.

Another object is to provide such an antenna which has small structural dimensions in a plane normal to its polarization axis. These and other objects of the present invention are achieved by an improvement in an antenna employed for the transmission of different frequency signals. The antenna is of the type which includes a cylindrical conductor that resonates at a frequency $f_1$ for which the length of the conductor is approximately one-quarter of a wavelength. The improvement comprises means for generating a current distribution in the antenna, when the antenna is operated in a band extending from $f_1$ to 4 $f_1$, that approximates the current distribution of a monopole whose physical length is approximately one-quarter of a wavelength at all frequencies in the band.

The resulting structure exhibits substantially uniform impedance and radiation with respect to frequency over a frequency band in excess of 5 to 1 and has very small dimensions in the horizontal plane. It is characterized by a high efficiency (ratio of power radiated from the antenna to the power delivered to the antenna) and has a uniformly low feedpoint impedance voltage-standing-wave-ratio relative to the characteristic impedance of the feed line.

Additional advantages and features will become apparent as the subject invention becomes better understood by reference to the following detailed description when taken in conjunction with the accompanying drawing wherein:

BRIEF DESCRIPTION OF THE DRAWING

The sole FIGURE shows a wideband transmitting antenna in accordance with the invention.

DESCRIPTION OF THE PREFERRED EMBODIMENT

The present invention is applicable to antennas that operate as half-wave antennas, that is, antennas whose electrical length is half the wavelength being transmitted, and which include a radiating element that physically is only a quarter wavelength long. Such antennas include monopoles and dipoles. The invention is an improvement in the radiating element.

The particular antenna shown in the FIGURE is a conventional monopole. It includes a radiating element in the form of a first cylindrical conductor 11 mounted vertically with its base just above the earth. The cylindrical conductor 11 is fed r-f energy from a transmitter 13 by a feed line 15. One side of the feed line 15 is connected to a feedpoint 17 at the base of the cylindrical conductor 11, and the other side of the feed line is connected to a metal screen 19 which is placed on the surface of the earth under the cylindrical conductor.

It is understood that the cylindrical conductor 11 is imaged in the earth in accordance with the principle of images. The phase of the equivalent current in the image conductor is such that the conductor-plus-image may be considered to be a single dipole in free-space, except that the electric intensity pattern is only half the free-space pattern since the earth "cuts off" the other half. This combination of a half dipole in conjunction with its image in a reflecting surface is the "monopole". At a frequency $f_1$, the cylindrical conductor 11 together with its image in the earth appears as a resonant circuit to the transmitter 13. The frequency $f_1$ is the frequency at which the length $h_1$ of the cylindrical conductor 11 is approximately one-quarter of a wavelength (i.e., $h \approx \lambda/4$ at $f_1$).

According to the invention, means is provided for generating a current distribution in the antenna, when the antenna is operated in a frequency band extending from $f_1$ to 4 $f_1$, that approximates the current distribution of a monopole whose physical length is approximately one-quarter of a wavelength at *all* frequencies in the band. The resulting antenna structure exhibits a nearly uniform input VSWR (voltage-standing-wave-ratio) and nearly uniform radiation characteristics over the width of the band.

While such means may take a variety of forms, conveniently it may take the form illustrated in the FIGURE of a plurality of second cylindrical conductors 22–28, whose lengths are one-quarter of a wavelength at respective frequencies in the band and which are positioned parallel to and spaced from the first conductor 11, and a plurality of resistors 32–38, each resistor connecting an end of a respective second conductor to one other conductor. The second conductors 22–28 form balanced two-wire transmission line traps with the conductors to which they are connected. The traps alter the current distribution in the first conductor 11 in a manner more specifically explained in the Naval Research Laboratory Formal Report No. 8546 entitled "A Compact Wideband Transmitting Antenna" which is publicly available from the National Technical Information Service, and in the article "A Compact Wideband HF Transmitting Antenna" published in the "1981 *International Symposium Digest-Antennas and Propagation*", Vol. 2, pp. 582–585, the disclosures of which are hereby incorporated by reference.

The plurality of second conductors 22–28 lie on and define in space a cylindrical surface 39 whose axis of revolution coincides with the longitudinal axis 41 of the first conductor 11, and whose radius D is very small (of the order of 0.1 or less) compared to a wavelength at any frequency in the band, thus providing for a compact antenna structure.

Each second conductor 22–28 has, with respect to one other conductor to which it is connected, a balanced two-wire transmission line trap characteristic impedance $Z_0$, and the diameters of the conductors are selected so that all values of $Z_0$ are the same. Each resistor has a finite resistance R, and all values of R are the same, being approximately proportional to the variable $Z_0$.

The respective lengths of the seven second conductors 22–28 are:

$h_2=\lambda/4$ at 1.33 $f_1$ $h_3=\lambda/4$ at 2 $f_1$ $h_4=\lambda/4$ at 3 $f_1$ $h_5=\lambda/4$ at 4 $f_1$ $h_6=\lambda/4$ at 3 $f_1$ $h_7=\lambda/4$ at 4 $f_1$ $h_8=\lambda/4$ at 4 $f_1$ The second conductors 22–25 whose lengths are $h_2$, $h_3$, $h_4$ and $h_5$ are connected to the first conductor 11 at the feedpoint 17 with their connected ends lying in a plane normal to the first conductor at the feedpoint. Starting with the second conductor 25 of length $h_5$ and referencing its location in the plane normal to the first conductor 11 at 0°, the second conductor 24 of length $h_4$ is at 90°, the second conductor 23 of length $h_3$ is at 180°, and the second conductor 22 of length $h_2$ is at 270°. The second conductor 26 whose length is $h_6$ is connected to the first conductor 11 and aligned with the center one-third of the first conductor. The second conductor 27 whose length is $h_7$ is connected to the first conductor 11 and aligned with the third one-quarter of the first conductor measured from the feedpoint 17. The second conductor 28 whose length is $h_8$ is connected to the second conductor 22 of length $h_2$ and aligned with the center one-third of the second conductor of length $h_2$. The projections in the plane normal to the first conductor 11 of the second conductors 26–28 whose lengths are $h_6$, $h_7$ and $h_8$ lie respective at 315°, 45°, and 225°.

The major operating parameters of an illustrative monopole antenna actually built and tested are given below. It will be appreciated that these values are by way of example only.

TABLE

Major Antenna Operating Parameters $h_1$: 10.671 meters
D: 0.203 meters
$Z_o$: 250 ohms
R: 37 ohms
$h_2$: 8.00325 meters
$h_3$: 5.3355 meters
$h_4$: 3.557 meters
$h_5$: 2.6675 meters
$h_6$: 3.557 meters
$h_7$: 2.6675 meters
$h_8$: 2.6675 meters Frequency range: 6 MHz to 32 MHz
Feedpoint VSWR: 4 or less
Radiation power density:
Variation in azimuthal plane is less than 3 dB at any frequency.
Variation near 0° elevation is from +4 dB to −5 dB relative to an isotropic antenna.
Radiation efficiency: Between 30 and 70 percent.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. In an antenna employed for the transmission of different frequency radio signals and including a first cylindrical conductor of length $h_1$, the conductor resonating at frequency $f_1$ for which $h_1$ is approximately one-quarter of a wavelength, that is, $h_1 \approx \lambda/4$ at $f_1$;

means for generating a current distribution in the antenna, when the antenna is operated in a band extending from $f_1$ to 4 $f_1$, that approximates the current distribution of a monopole whose physical length is approximately one-quarter of a wavelength at all frequencies in the band, said means for generating a current distribution in the antenna including:

a plurality of second cylindrical conductors positioned parallel to and spaced from the first conductor;

the length of each second conductor being one-quarter of a wavelength at a respective frequency in the band; and a plurality of resistors;

each resistor connecting an end of a respective second conductor to one other conductor;

the second conductor forming balanced two-wire transmission line traps with the conductors to which they are connected.

2. The antenna recited in claim 1 wherein:

the plurality of second conductors lie on and define a cylindrical surface whose axis of revolution coincides with the longitudinal axis of the first conductor and whose radius D is very small compared to a wavelength at any frequency in the band;

whereby the antenna diameter is confined to a small value so that the antenna is compact.

3. The antenna recited in claim 2 wherein:

each second conductor has, with respect to the one other conductor to which it is connected, a balanced two-wire transmission line trap characteristic impedance $Z_0$, and all values of $Z_0$ are the same;

each resistor has a resistance R, and all values of R are the same and approximately proportional to the value of $Z_0$.

4. The antenna recited in claim 3 wherein:

the first conductor has a feedpoint;

the second conductors are seven in number and have respective lengths $h_2=\lambda/4$ at 1.33 $f_1$ $h_3=\lambda/4$ at 2 $f_1$ $h_4=\lambda/4$ at 3 $f_1$ $h_5=\lambda/4$ at 4 $f_1$ $h_6=\lambda/4$ at 3 $f_1$ $h_7=\lambda/4$ at 4$f_1$ $h_8=\lambda/4$ at 4 $f_1$ the second conductors whose lengths are $h_2$, $h_3$, $h_4$ and $h_5$ are connected to the first conductor at the feedpoint with their connected ends lying in a plane normal to the first conductor at the feedpoint;

starting with the second conductor of length $h_5$ and referencing its location in the plane normal to the first conductor at 0°, the second conductor of length $h_4$ is at 90°, the second conductor of length $h_3$ is at 180°, and the second conductor of length $h_2$ is at 270°, the second conductor whose length is $h_6$ is connected to the first conductor and aligned with the center one-third of the first conductor;

the second conductor whose length is $h_7$ is connected to the first conductor and aligned with the third one-quarter of the first conductor measured from the feedpoint;

the second conductor whose length is $h_8$ is connected to the second conductor of length $h_2$ and aligned with the center one-third of the second conductor of length $h_2$; and the projections in the plane normal to the first conductor of the second conductors whose lengths are $h_6$, $h_7$ and $h_8$ lie respectively at 315°, 45°, and 225°.

* * * * *